United States Patent [19]

Allgood

[11] 4,361,833

[45] Nov. 30, 1982

[54] MULTI-SENSOR ALARM SYSTEM AND METHOD OF PROTECTING A PREMISES

[75] Inventor: Richard P. Allgood, Bushnell, Fla.

[73] Assignee: Monitran International, Inc., Nassau, The Bahamas

[21] Appl. No.: 133,807

[22] Filed: Mar. 25, 1980

[51] Int. Cl.[3] ..... G08B 29/00

[52] U.S. Cl. ..... 340/533; 340/506; 340/508; 340/511; 340/537

[58] Field of Search ..... 340/506, 533, 508, 511, 340/517, 520, 521, 531, 536, 537, 525

[56] References Cited

U.S. PATENT DOCUMENTS

| | | | |
|---|---|---|---|
| 3,699,569 | 10/1972 | Lee | 340/521 |
| 3,702,474 | 11/1972 | Fink et al. | 340/511 |
| 3,820,102 | 6/1974 | Schubert | 340/533 |
| 3,821,733 | 6/1974 | Reiss et al. | 340/537 |

*Primary Examiner*—Thomas A. Robinson
*Assistant Examiner*—Donnie L. Crosland
*Attorney, Agent, or Firm*—Kirschstein, Kirschstein, Ottinger & Cobrin

[57] ABSTRACT

A multi-sensor alarm system and method of protecting a premises include at least one sensor circuit and an alarm circuit which together establish a two-wire closed loop electrical circuit path in which a wide variety of alarm sensors are accommodated. The sensors include two-contact configurations which are normally-closed or normally-open, as well as multiple-contact configurations which are characterized by both normally-closed and normally-open contacts. Each sensor differently changes the electrical parameters of the circuit path; and the alarm circuit includes a transistor which senses each parameter change, and a timer which generates an alarm signal whenever any of the sensors is actuated. Opening or closing the circuit path at any point therein will cause the alarm signal to be generated. A status indicator constantly monitors and supervises the status of the sensors in the circuit path. An alarm indicator is latched to the ON-state to constantly indicate the fact that the alarm signal has been generated. A manual-reset switch returns the alarm indicator to its OFF-state. The alarm system reconditions itself such that more than one sensor can be tripped, no matter whether the particular sensor is of the non-resettable or of the automatically-resetting type.

29 Claims, 2 Drawing Figures

MULTI-SENSOR ALARM SYSTEM AND METHOD OF PROTECTING A PREMISES

BACKGROUND OF THE INVENTION

1. Field of the Invention

The present invention generally relates to alarm systems and, more particularly, to a multi-zone alarm system for, and method of, protecting a premises from alarm events such as burglary and fire.

2. Description of the Prior Art

Conventional alarm systems have not proven to be altogether satisfactory in preventing unauthorized entry and/or in preventing fire damage to industrial and/or home premises. With the evergrowing sophistication of the intruder or arsonist, conventional alarm systems are easily compromised by short- or open-circuiting the individual alarm sensor devices.

In a typical conventional alarm system installation, a plurality of burglary-type sensors are mounted in one closed circuit loop, and a plurality of fire-type sensors are mounted in another closed circuit loop. However, the burglary sensors are all of the same type, generally series-connected normally-closed switches each having two contacts. The fire sensors are likewise all of the same type, generally parallel-connected normally-open switches each having two contacts. Each loop has its own alarm sensing element for detecting whether a burglary sensor or a fire sensor has been actuated.

In order to overcome the increasing expertise of the intruder/arsonist, more sophisticated burglary and fire sensors, such as infrared light, ultrasonic sound, microwave, have been developed. These sophisticated sensors are switches having a three-contact configuration. One contact is a common contact, and defines a normally-closed branch path with a second contact, and defines a normally-open branch path with a third contact. However, in order to install these multiple contact sensors into an existing two-wire loop, adaptors for converting a three-contact switch to a two-contact switch are needed.

The above-described installation techniques suffer from many disadvantages. First of all, it is easy to compromise the burglary sensors by simply jumping its respective two contacts. The fire sensors are easily compromised by cutting the conductors leading to its respective two contacts. A combination fire-burglary system requires two loops, two sensing elements, and extra wiring. This represents additional costs not only in duplication of parts, but also in terms of the labor required to install the extra loops around a premises. Moreover, the extra wiring increases the probability of accidental breaks, thereby leading to inadvertent tripping of the alarm by the user of the premises. Still further, the sophisticated multiple contact sensors cannot be inexpensively installed, because they require additional wiring and expensive adaptors.

SUMMARY OF THE INVENTION

1. Objects of the Invention

Accordingly, it is the general object of the present invention to overcome the aforementioned drawbacks of the prior art.

Another object of the present invention is to provide a multi-sensor alarm system in which burglary sensors of the normally-open double contact type, or of the normally-closed double contact type, or of the sophisticated multiple contact type, can all be mounted in the same two-wire closed circuit loop.

An additional object of this invention is to provide a multi-sensor alarm system in which fire sensors of the normally-open double contact type, or of the normally-closed double contact type, or of the sophisticated multiple contact type, can all be mounted in the same two-wire closed circuit loop.

Another object of this invention is to provide a multi-sensor alarm system in which both burglary and fire sensors can be mounted now in the same two-wire closed circuit loop.

Still another object of the present invention is to eliminate the necessity for mounting fire sensors in one loop and burglary sensors in another loop.

An additional object of this invention is to eliminate the necessity for using adaptors to mount multiple-contact sensors in an already existing circuit loop.

Another object of this invention is to reduce the length and cost and labor involved in installing extra circuit loops in a premises to be protected.

Still another object of this invention is to reduce the probability of accidental breaks in the circuit wiring.

A further object of this invention is to wire a premises with maximum flexibility.

Another object of the present invention is to wire a premises with an alarm system which is not restricted to the type of configuration with which the sensor is normally supplied.

Still another object of this invention is to simplify the maintenance of the alarm system.

A further object of this invention is to provide a tamper-proof multi-sensor alarm system which will alert the occupant whenever any attempt is made to bridge, jump, short, cut or open the circuit path.

An additional object of this invention is to track an intruder/arsonist during his travel throughout a premises.

Still another object of this invention is to provide a multi-sensor alarm system which will recondition itself for subsequent alarms.

Yet another object of this invention is to provide a novel method of protecting a premises.

2. Features of the Invention

In keeping with these objects and others which will become apparent hereinafter, one feature of the invention resides, briefly stated, in a multi-sensor alarm system for, and method of, protecting a premises. The invention includes an electrical circuit means for establishing a two-wire closed loop circuit path having a load impedance through which an electrical current is conducted.

Three different types of burglary and/or fire sensors are connected in the same two-wire circuit path. A first type of normally-closed sensor is actuatable from a non-alarm state to an alarm state in which the current is respectively permitted or prevented from being conducted through the first sensor. A second type or normally-open sensor is actuatable from a non-alarm state to an alarm state in which the current is respectively prevented or permitted from being conducted through the second sensor. A third type is a multiple contact switch which defines two branch paths. One is normally-closed, and the other is normally-open in the non-alarm state. In the alarm state, the condition of the branch paths reverses.

Each sensor is operative to differently change the current and voltage characteristics of the two-wire circuit path. An alarm means is operative to sense each differently changed circuit characteristic, and to generate an alarm signal when any of the sensors is in its respective alarm state.

Hence, in accordance with the invention, a single two-wire circuit path is required to only accommodate all the various types of burglary sensors, or all the various types of fire sensors, or both the fire and the burglary sensors together. It is no longer necessary to restrict a single two-wire circuit path to only burglary sensors of a single type, or to only fire sensors of a single type; nor is it any longer necessary to mount sensors in different loops, thereby reducing the additional wiring and installation costs. The frequency of accidental breaks in the circuit path is reduced. The alarm system is not restricted to any particular type of contact configuration with which the sensor is normally supplied. Adaptors are no longer needed to accommodate the more sophisticated multiple contact sensors. Maintenance throughout the alarm system is greatly improved. A premises can be wired with maximum flexibility. The alarm system is tamper-resistant, because it will alert the occupant to any attempt to bridge, jump, short, cut or open the circuit path.

Still another feature of the invention is that the individual sensors are mounted in the circuit path such that one sensor can be actuated even after another sensor has already been actuated and has remained in its respective alarm state. Even if one sensor is of the automatically-resetting type and has returned to its non-alarm state, the other sensors are still operational to generate subsequent alarm signals.

The independent operation of the sensors can be used to track the course of an intruder through the premises. This information can be useful to law enforcement personnel.

The novel features which are considered as characteristic of the invention are set forth in particular in the appended claims. The invention itself, however, both as to its contruction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
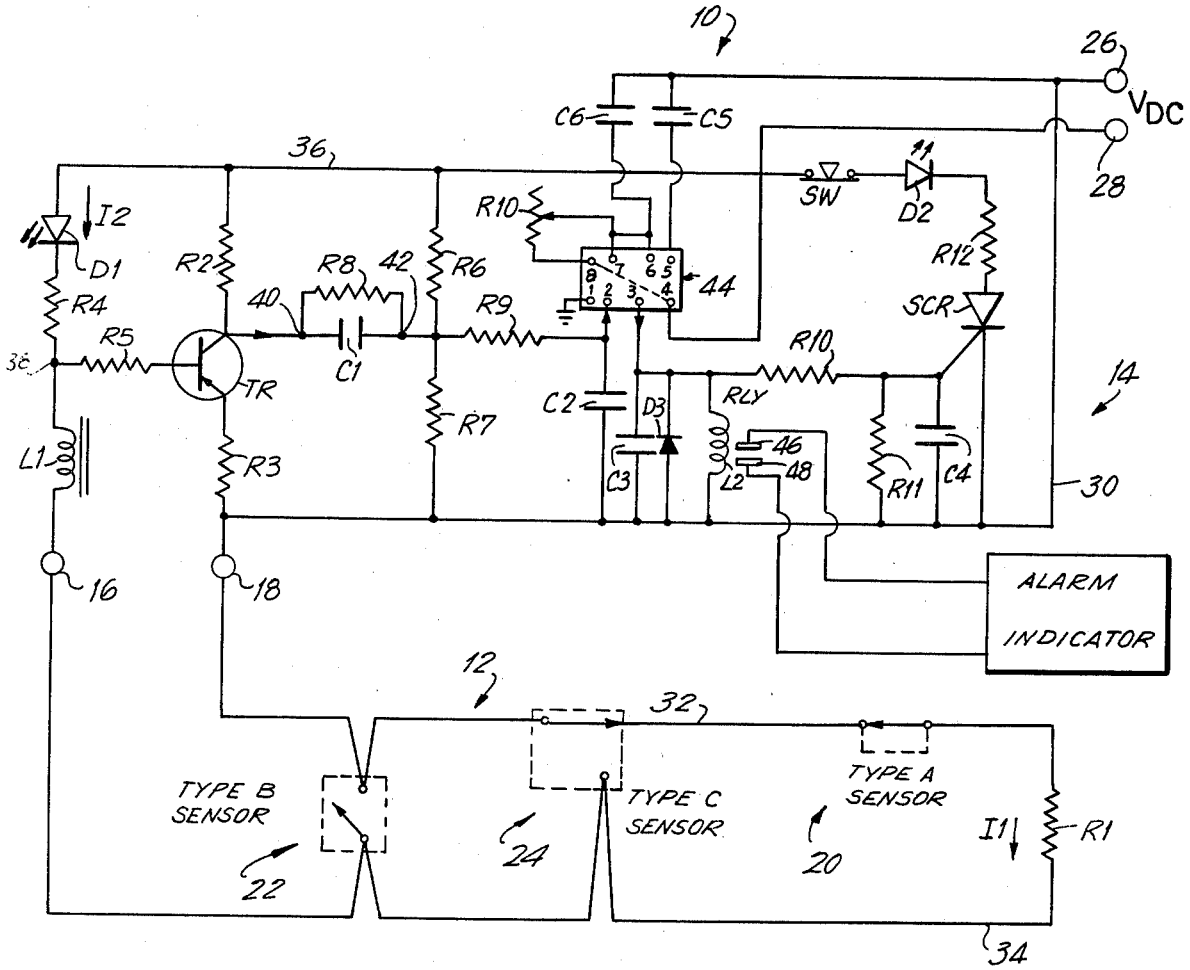
FIG. 1 is an electrical circuit schematic diagram of one embodiment of the multi-sensor alarm system in accordance with the present invention.

Referring now to FIG. 1, reference numeral 10 generally identifies the multi-sensor alarm system for, and method of, protecting a premises in accordance with this invention. The system 10 basically comprises a sensor circuit 12 and an alarm circuit 14 which are electrically interconnected at terminals 16,18. At least one, and preferably a plurality of sensor devices, are electrically connected in the sensor circuit 12. The individual sensor devices, as described below, may all be of one type, or may all be of a different type, or may constitute various types in the same sensor circuit. All of the sensor devices of whatever type are distributed at desired locations of a premises to be protected.

As shown in FIG. 1, three different types of sensor devices are connected in the same single sensor circuit 12, which can serve as either a burglary-detection circuit only, or as a fire-detection circuit only, or as a combination burglary- and fire-detection circuit. However, this is not intended to be self-limiting on the invention in any way, because it is to be expressly understood that more than one sensor circuit, and that any number and type of sensor devices, are intended to be within the spirit of this invention. As described below in connection with FIG. 2, a plurality of independent sensor circuits, each connected to its own respectively-associated alarm circuit, can be utilized. In that case, one sensor circuit can be provided with a plurality of sensor devices which are all of one type; another sensor circuit can be provided with a plurality of sensor devices which are all of a different type; and still another sensor circuit can be provided with a plurality of sensor devices which are all of still a different type.

Reference numeral 20 identifies a type A sensor which is commonly, but not exclusively, used to detect burglary events. Type A sensors can be generally represented as two-contact switches whose contact configuration is of the normally-closed type. The type A sensor permits an electrical current to pass therethrough in its normally-closed (non-alarm) state. However, upon actuation, the type A sensor assumes an open (alarm) state and prevents the electrical current from being conducted therethrough. Typical examples of normally-closed type A burglary sensors are lead window foils, magnetic door switches, vibration detectors (tremblers), mercury window switches, etc. A typical example of a normally-open burglar sensor is a floor mat switch.

Reference numeral 22 identifies a type B sensor which is commonly, but not exclusively, used to detect fire events. Type B sensors can be generally represented as two-contact switches whose contact configuration is of the normally-open type. The type B sensor prevents an electrical current from passing therethrough in its normally-open (non-alarm) state. However, upon actuation, the type B sensor assumes a closed (alarm) state and permits the electrical current to pass therethrough. Typical examples of type B normally-open fire sensors are thermal detectors, rate of rise detectors, rate anticipation detectors, light refraction smoke detectors, product of combustion detectors, infrared detectors, etc.

Reference numeral 24 identifies a type C sensor which is commonly used to detect either burglary or fire events. Type C sensors can be generally represented as three- (or more) or multiple contact switches which have two branches. In its non-alarm state, the type C sensor permits an electrical current to pass through one of its branches, but prevents the electrical current from conducting through the other. In its alarm state, the type C sensor prevents the current from passing through the first-mentioned one branch and permits the current to pass through the second-mentioned other branch. Type C sensors, therefore, have a normally-closed and normally-open contact configuration in its non-alarm state, and the inverse contact configuration in its alarm state. Type C sensors are generally associated with the more sophisticated burglary detectors which are currently being sold. Typical examples of type C burglary sensors are of the infrared light type, the ultrasonic sound type, the microwave type, the seismic type, etc. However, it is to be expressly understood that any of the above-mentioned sensors, i.e. fire as well as burglary, are sold with contact configurations of the C type.

The system 10 includes electrical circuit means for establishing a two-wire closed loop circuit path in which all of the sensors 20,22,24 are electrically connected. An electrical current $I_1$ is conducted along the circuit path which starts from negative terminal 26 of a DC power supply along conductor 30 to terminal 18, and thereupon along conductor 32 through an end-of-line load resistor $R_1$. The current $I_1$ returns along conductor 34 to terminal 16, and thereupon through various circuit components, e.g. $L_1$, $R_4$, $D_1$, along conductor 36 to the positive terminal 28 of the DC power supply.

As noted above, the sensors 20,22,24 are mounted in the above-described closed loop circuit path. Normally-closed sensor 20 is connected in series with the load resistor $R_1$; normally-open sensor 22 is connected in parallel across the load resistor $R_1$; and sensor 24 is connected in cascade relative to the load resistor $R_1$; that is, one normally-closed branch is connected in series with the load resistor, whereas the other normally-open branch is connected in parallel across the load resistor. It is noted that sensor 20 is located nearest to the load resistor, that sensor 22 is located furthest from the load resistor, and that sensor 24 is located intermediate the sensors 20,22.

When normally-closed sensor 20 detects an alarm event, the sensor 20 opens, and the current $I_1$ no longer flows through the load resistor $R_1$. Put another way, an open circuit condition appears across terminals 16, 18.

When normally-open sensor 22 detects an alarm event, the sensor 22 closes, and the current no longer flows through the load resistor, but instead flows through the sensor 22 itself. Similarly, when sensor 24 detects an alarm event, the sensor 24 changes from its illustrated condition, and produces a short circuit across the load resistor. Put another way, a short circuit condition appears across terminals 16, 18 when either sensor 22 or 24 is actuated.

It will be observed that no matter whether sensor 20, or 22, or 24 is actuated, the electrical characteristics of the sensor circuit 12, as measured at terminal 16 and 18, is changed. The change in the voltage and current parameters is different for the sensor 20, as contrasted to the change for the sensors 22 or 24.

In accordance with this invention, the alarm circuit 14 is operative to sense either of these differently changed electrical characteristics of the sensor circuit 12, and then to generate an alarm signal when any of the sensors have been actuated from their illustrated non-alarm states to their respective alarm states upon respective detection of an alarm event, such as burglary or fire situations.

The alarm circuit 14 includes a radio frequency choke $L_1$ for minimizing radio interference; and an pnp transistor TR connected in the circuit path in which the sensors are located, and operative for sensing the differently changed voltage and current parameters of the sensor circuit 12. Biasing resistor $R_2$ is connected between the collector and the positive power terminal 28; biasing resistor $R_3$ is connected between the emitter and the negative power terminal 26; biasing resistor $R_4$ is connected between the base and the positive terminal 28. Resistor $R_5$ is a decoupling resistor. The load resistor $R_1$ is likewise a biasing resistor, because it is located in the transistor biasing network; specifically, one side of the load resistor is connected to resistor $R_3$ and the other side of the load resistor is connected to the junction 38 between resistors $R_4$ and $R_5$.

All of the biasing resistors $R_1$, $R_2$, $R_3$, $R_4$, are selected to bias the transistor TR into a "just-turned-on" or equilibrium condition. The transistor is a switching element which can be switched between a fully-on (saturated) condition and a fully-off (cut-off) condition. All the biasing resistors are chosen to establish the equilibrium condition somewhere between the saturated and cut-off conditions. A balance is obtained whereby an increase in voltage at base terminal 38 will drive the transistor into saturation, or conversely a decrease in voltage at base terminal 38 will drive the transistor into cut-off.

The equilibrium condition is adjustably set, either by careful selection of the biasing resistors, or by making any one or more of the biasing resistors a potentiometer, and therefore adjustable. For example, end-of-line resistor $R_1$ may be adjustable. Typically, the end-of-line resistor measures 2500 ohms.

Also connected between the collector and the base of the transistor is a light-emitting diode $D_1$. Diode $D_1$ serves as a supervisory means for constantly monitoring the status of the sensors in the sensor circuit, as described below.

In order to more particularly set forth the illustrated normal equilibrium condition, let us assume for the sake of convenience that the voltage across power terminals 26,28 is approximately 15 volts DC. The biasing resistors $R_1$–$R_4$ bias the transistor such that the base input voltage 38 is on the order of 8.5 volts. The collector output voltage at terminal 40 is on the order of 7.5 volts. The current $I_2$ passing through the supervisory diode $D_1$ is just enough to dimly light it. All the sensors are in their respective non-activated states.

Now, if sensor 20 opens and produces an open circuit across terminals 16, 18, then the base input voltage will suddenly increase from 8.5 v towards 15 v. The transistor will be driven into cut-off, and cause the collector output voltage to suddenly fall from 7.5 v towards 0 v. The current $I_2$ will concomitantly suddenly decrease and cause the supervisory diode $D_1$ to be extinguished.

Alternatively, if either sensor 22 or sensor 24 closes and produces a short circuit across terminals 16, 18, then the base input voltage will suddenly decrease from 8.5 v towards 0 volts. The transistor will be driven into saturation and cause the collector output voltage to suddenly rise from 7.5 v towards 15 volts. The current $I_2$ will concomitantly suddenly increase and cause the supervisory diode $D_1$ to emit much more light than before.

Hence, the transistor detects either open- or short-circuits across terminals 16, 18; that is, the same transistor can detect whether the current and voltage parameters of the sensor circuit are less than, or greater than, the predetermined equilibrium current and voltage parameters. At the same time, a user can visually check the light output of the supervisory diode to determine whether the sensors are still in their non-alarm states (diode dim), or whether the normally-closed sensor has been actuated to its alarm state (diode extinguished), or whether the normally-open sensors have been actuated to their alarm states (diode very bright).

The alarm circuit 14 includes a timer 44 operative for generating the alarm signal for a predetermined time period which is independent of any other time interval. The timer 44 is preferably an integrated chip type No. 555 which has eight terminals. Terminal 1 is grounded.

Terminal 2 is an input terminal for receiving an electrical input timer signal generated from the collector output voltage of the transistor. Terminal 3 is an output terminal for supplying the alarm signal. Terminal 4 is connected to the positive terminal 28. Terminal 5 is connected to the negative terminal 26 through the decoupling capacitor $C_5$. Terminal 6 is connected to the negative terminal 26 through the time constant capacitor $C_6$. Terminal 7 is directly connected to terminal 6, and is connected to the wiper arm of time constant potentiometer $R_{10}$. Terminal 8 is connected to one end of the potentiometer $R_{10}$, and is also directly connected to terminal 4. The resistance of potentiometer $R_{10}$ and the capacitance of capacitor $C_6$ determine the time constant of the independent time period of the timer. The potentiometer $R_{10}$ serves as the means for adjusting the time duration of this time period. Typically, the time constant is set for about 15 seconds.

The timer 44 will produce the alarm signal at the output terminal 3 for the predetermined time period whenever a negative-going signal is applied at input terminal 2. It will be recalled that the collector output voltage at terminal 40 either decreases (sensor 20) or increases (sensors 22,24). Hence, it is necessary to modify the voltage at terminal 40 so that there is a negative-going signal in all cases.

The processing means for modifying the collector output voltage includes a charging-discharging processor sub-circuit which comprises a resistor $R_8$ and a capacitor $C_1$ connected in parallel with each other. A voltage divider constituting resistors $R_6$ and $R_7$ is connected between the positive and negative power terminals 28, 26. The sub-circuit is connected between terminals 40,42; the terminal 42 is located at the junction between the resistors $R_6$, $R_7$. The current-limiting resistor $R_9$ connects terminal 42 to the input timer terminal 2. A capacitor $C_2$ for minimizing radio frequency interference is connected between input terminal 2 and terminal 26.

In the aforementioned equilibrium position, 15 volts is present across the power terminals, and 7.5 volts is present at voltage divider terminal 42. This 7.5 volts represents a substantially constant biasing or reference value for the output of the processor sub-circuit. The quiescent collector output voltage value is also about 7.5 volts, and therefore very little, if any, current is applied to the timer input terminal 2. The timer is turned off. Put another way, the timer generates a non-alarm signal at output terminal 3.

Now, if the collector output voltage at terminal 40 suddenly increases from 7.5 volts towards 15 volts, then the voltage at terminal 42 likewise suddenly increases, and thereupon discharges back to 7.5 volts. A negative-going signal is generated at the trailing edge of the voltage waveform at terminal 42.

Conversely, if the collector output voltage at terminal 40 suddenly decreases from 7.5 volts towards 0 volts, then the voltage at terminal 42 likewise suddenly decreases, and thereupon charges back to 7.5 volts. A negative-going signal is generated at the leading edge of the voltage waveform at terminal 42.

In either case, a negative-going signal is applied to timer input terminal 2 to thereby generate a timer output signal at timer output terminal 3. The timer output signal generally has a voltage amplitude of about 9–9.5 volts. The timer output signal is conducted to an alarm relay RLY which has a relay coil $L_2$ and normally-open relay contacts 46,48. The alarm signal energizes the coil $L_2$ and is operative to close the contacts, to thereby generate the alarm signal which is conducted to the alarm device. The alarm device can be connected to a distant monitoring station via radio, phone lines, or other means.

The back electromotive force caused by collapse of the magnetic field in the relay coil $L_2$ is smoothed by diode $D_3$ which is connected across the latter. The capacitor $C_3$ serves to filter and smooth out any voltage spikes.

An alarm indicator means or light-emitting diode $D_2$ is operative for visually indicating the generation of the alarm signal. The diode $D_2$ is actuatable from its non-activated OFF-state to its activated ON-state whenever the alarm signal is generated. A latching means or silicon controlled rectifier SCR is operative for maintaining the diode $D_2$ in the ON-state whenever the alarm signal is generated.

In the equilibrium condition, the output timer terminal 3 is connected to the gate of the SCR through a decoupling resistor $R_{10}$. The gate bias resistor $R_{11}$ is operative to bias the gate voltage to be at a value less than its threshold value, e.g on the order of 2.0 volts. The gate capacitor $C_4$ serves to minimize line transients.

A manually-resettable normally-closed switch SW is connected between the positive terminal 28 and the anode of diode $D_2$. The cathode of diode $D_2$ is connected in series with a current-limiting resistor $R_{12}$, which in turn is connected to the anode of the SCR. The cathode of the SCR is connected to the negative terminal 28.

In operation, whenever a timer output signal is generated, a voltage larger than the threshold voltage is applied to the gate of the SCR, thereby turning the latter on. The SCR stays on, even after the timer output signal has terminated, because current is still flowing through the SCR. The SCR can only be turned off by resetting the switch SW, i.e. by interrupting the current flow through the SCR.

The light-emitting diode $D_2$ emits a red-colored light in its ON-state. In its OFF-state, the diode $D_2$ is extinguished. By contrast, the light-emitting diode $D_1$ emits a green-colored light when it is either dimly or brightly lit. The different colors serve to distinguish the diodes and their different functions.

It will therefore be seen that type A and/or type B and/or type C sensors or any combinations thereof can be connected in the same two-wire closed loop, and that any shorting or opening of any of the contacts will be sensed to thereby generate an alarm signal.

Furthermore, the actuation of one sensor does not mean that the other sensors will automatically be rendered inoperative. For example, if sensor 20 is actuated, then, after its alarm signal has expired fifteen seconds later, the sensor circuit is still operative, because either sensor 24 or sensor 22 can still be actuated. After another 15 second delay, either sensor 22 or 24 can still later be actuated if they are of the automatically-rearming type and have returned to their non-alarm state, whether or not sensor 20 remains in the alarm state or returns to the non-alarm state. Put another way, sensor 20 need not be of the automatically-rearming type.

In a preferred installation technique, sensor 20 is a perimeter-type sensor, i.e. a sensor which is arranged at the exterior parts of a premises to be protected. For example, perimeter-type sensors protect doors and windows. Sensor 24 is preferably a room- or area-type sensor of the automatically-rearming type for protecting interior room areas of the premises. For example, area-type sensors protect wide zones of coverage, like carpets, interior room doors, etc. Sensor 22 is preferably an interior-type sensor of the automatically-rearming type for protecting items located in the rooms of the premises. For example, a safe can be protected by sensor 22. Inasmuch as an intruder will trip sensors 20,24 and 22 in that order, and that each of these sensors can still be actuated even if the perimeter sensor 20 remains in its alarm state, it will be possible to track the course of the intruder through the premises with the multi-zone alarm system of this invention. Of course, if all the sensors are of the automatically-rearming type, it doesn't matter what the order of tripping the sensors will be.

In the event that any one of the sensors is of the automatically-resetting type and returns to its non-alarm state at any time other than during the timing cycle, the processor sub-circuit also acts as a buffer circuit to absorb any contact activity. Thus, the $R_8$-$C_1$ sub-circuit serves to introduce a slight time delay which prevents the timer 44 from retriggering.

Figure 2:
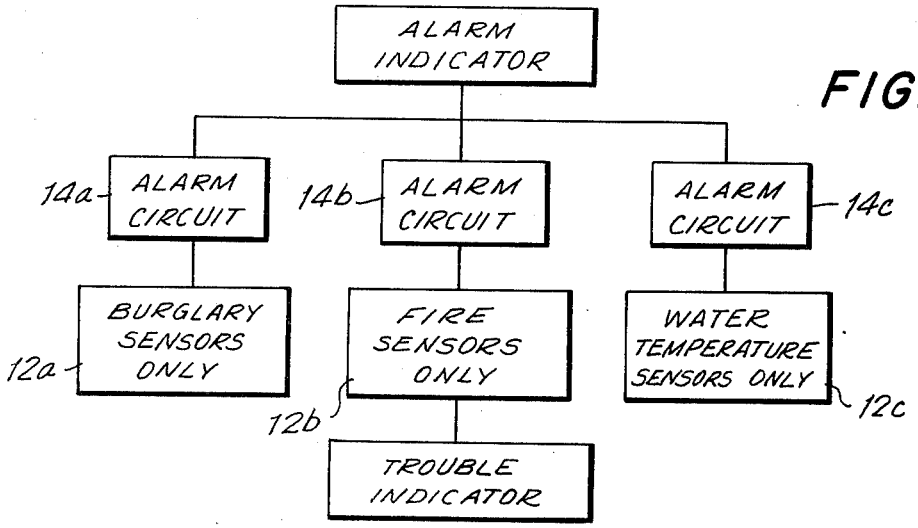
FIG. 2 is another embodiment of the multi-sensor alarm system in accordance with the present invention.

Turning now to FIG. 2, another embodiment of this invention comprises connecting all the burglary sensors in one sensor circuit, all the fire sensors in another sensor circuit, and all other sensors, e.g. water temperature sensors, in still another sensor circuit. By segregating the burglary, fire and water temperature sensors, each type of alarm can be readily distinguished from the others.

As described above, burglary sensors typically have normally-closed double contact configurations. However, this is not necessarily so, because some burglary sensors have normally-open double contact configurations, e.g. floor mat switches, and the more sophisticated burglary sensors have multiple contact configurations. Nevertheless, all of these different contact configurations can all be mounted in the same sensor circuit **12*a*** which is operative for exclusively detecting burglary events.

In analogous manner, fine sensors can have double- or triple-contact configurations, and can either be normally-open (UL approved) or normally-closed (UL non-approved). All of these different contact configurations can all be mounted in the same sensor circuit **12*b*** which is operative for exclusively detecting fire events.

Also, in analogous manner, water temperature or the like sensors can be of normally-open or normally-closed type, or have multiple contact configurations. These sensors are all mounted in the same sensor circuit **12*c*** which is exclusively operative for detecting that particular alarm event, e.g. water overheating or freezing.

As shown in FIG. 2, the burglary, fire and water temperature sensor circuits **12*a*, 12*b*, 12*c* are each provided with their own respective alarm circuit 14*a*, 14*b*, 14*c* which are analogous to the above-described alarm circuit 14**. One alarm indicator is sufficient, or if desired, separate alarm indicators can be utilized.

Still another feature of the invention is a trouble indicator circuit connected with the fire sensor circuit **12*b*. It is desirable to alert the fire department of a fire event only when a short-circuit is established across terminals 16,18 of the two-wire closed fire loop. If an open-circuit or break is made across terminals 16,18** of the fire loop, then it is not desired to alert the fire department, but instead, to locally alert the occupant that there is "trouble" in the fire loop.

The trouble alarm circuit is roughly analogous to the alarm circuit 14 of FIG. 1, except that resistor $R_2$ is removed, and that terminal 38 is directly connected to terminal 40, thereby shorting out the transistor TR. In this modified configuration, a closure of the fire sensor in the fire loop will produce a negative-going signal at terminal 42 for the timer 44, because the voltage at terminal 38 will suddenly decrease from about 8.5 v towards 0 volts. As before, the negative-going signal fed to the timer will generate the fire alarm signal.

However, an open or break in the fire loop will not produce a negative-going signal at terminal 42, because the voltage at terminal 38 will rise from 8.5 v towards 15 v and remain at 15 v for as long as the fire loop is open. This positive-going signal is used as a trigger input for an additional trigger signal processing circuit which will generate a trouble signal which is distinctive from the aforementioned alarm signal. The trouble signal is locally annunciated, either auditorily and/or visually, and is generally not transmitted to the fire department station.

It will be understood that each of the elements described above, or two or more together, may also find a useful application in other types of constructions differing from the types described above.

While the invention has been illustrated and described as embodied in a multi-sensor alarm system and method of protecting a premises, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A multi-sensor alarm system, comprising:

(a) electrical circuit means for establishing a two-wire closed loop circuit path having a load impedance through which an electrical current is conducted;

(b) first sensor means electrically connected in the two-wire closed loop circuit path for detecting an alarm event, said first sensor means being actuatable in response to detection of the alarm event from a non-alarm state in which the electrical current is conducted through the first sensor means, to an alarm state in which the electrical current is prevented from being conducted through the first sensor means;

(c) second sensor means electrically connected in the same two-wire closed loop circuit path for detecting the alarm event, said second sensor means being actuatable in response to detection of the alarm event from a non-alarm state in which the electrical current is prevented from being conducted through the second sensor means, to an alarm state in which the electrical current is conducted through the second sensor means;

(d) each of said sensor means being respectively operative to differently change the electrical characteristics of the two-wire closed loop circuit path in response to actuation of each sensor means between its respective states;

(e) alarm means electrically connected to the same two-wire closed loop circuit path, for sensing either differently changed electrical characteristic of the circuit path, and for generating an alarm signal when either of the sensor means is in its respective alarm state, said alarm means including a switching element actuatable among a fully-on switched condition, a fully-off switched condition, and an equilibrium condition intermediate the fully-on and fully-off switched conditions, and means for establishing the equilibrium condition when both sensor means are in their non-alarm states, and wherein each of said sensor means is operative to actuate the switching element away from its equilibrium condition when either sensor means is in its respective alarm state; and (f) supervisory means for constantly monitoring the status of the switching element and the sensor means, said supervisory means being operative to separately indicate when both sensor means are in their non-alarm states and said switching element is in its equilibrium condition, and to separately indicate when said first sensor means is in its respective alarm state and said switching element is in one of said switched conditions, and to separately indicate when said second sensor means is in its respective alarm state and said switching element is in the other of said switched conditions.

2. The multi-sensor alarm system as defined in claim 1, wherein said load impedance is an end-of-line load resistor; and wherein said first sensor means is a normally-closed sensor device electrically connected in series with the load resistor; and wherein said second sensor means is a normally-open sensor device electrically connected in parallel with the load resistor.

3. The multi-sensor alarm system as defined in claim 1; and further comprising a third sensor means having two branch portions electrically connected in the two-wire closed loop circuit path for detecting the alarm event, said third sensor means being actuatable in response to detection of the third alarm event from a non-alarm state in which the electrical current is conducted through one branch portion of the third sensor means, to an alarm state in which the electrical current is conducted through the other branch portion of the third sensor means.

4. The multi-sensor alarm system as defined in claim 3, wherein said load impedance is an end-of-line load resistor; and wherein said one branch portion of the third sensor means is normally-closed and is electrically connected in series with the load resistor, and wherein said other branch portion of the third sensor means is normally-open and is electrically connected in parallel with the load resistor.

5. The multi-sensor alarm system as defined in claim 1, wherein said alarm means detects current and voltage changes in the closed loop circuit path, and generates in response to such detection a non-alarm signal when the current and voltage parameters of the closed loop circuit path are at predetermined values, and also generates in response to such detection the alarm signal when the current and voltage parameters are at values different from said predetermined values.

6. The multi-sensor alarm system as defined in claim 5, wherein said alarm means generates the alarm signal when the current and voltage parameters are less than, as well as greater than, said predetermined values.

7. The multi-sensor alarm system as defined in claim 1, wherein said switching element constitutes a transistor which is switchable between a fully-saturated condition and a fully cut-off condition; and wherein said equilibrium-establishing means biases the transistor at an equilibrium condition which is intermediate the saturated and cut-off conditions.

8. The multi-sensor alarm system as defined in claim 1, wherein said equilibrium-establishing means adjustably sets the equilibrium condition at a pre-selected value between the fully-on and the fully-off conditions.

9. The multi-sensor alarm system as defined in claim 1, wherein said supervisory means is a single multi-indicator device of the visually-indicating type.

10. The multi-sensor alarm system as defined in claim 1, wherein each of said sensor means is deactuatable from its respective alarm state back to its non-alarm state after the lapse of a time interval which ends when the respective alarm event is terminated, and wherein said alarm means includes timer means for maintaining the generation of the alarm signal for a predetermined time period which is independent of each said time interval.

11. The multi-sensor alarm system as defined in claim 10; and further comprising means for adjusting the time duration of said predetermined time period.

12. The multi-sensor alarm system as defined in claim 10, wherein said alarm means generates an electrical timer input signal when either of the sensor means is in its respective alarm state, and wherein said alarm means includes processor means for electrically modifying said timer input signal to maintain said alarm signal for said predetermined time period whenever said timer input signal is generated.

13. The multi-sensor alarm system as defined in claim 12, wherein said processor means includes a charging-discharging processor sub-circuit having an input and an output, and means for applying a substantially constant voltage biasing value at the output of the processor sub-circuit, and means for applying the electrical timer input signal to the input of the processor sub-circuit for respectively charging and discharging the same when the voltage magnitude of the timer input signal is respectively greater, and less than, said substantially constant biasing value.

14. The multi-sensor alarm system as defined in claim 13, wherein said processor sub-circuit includes a resistor and a capacitor electrically connected in parallel with each other, and wherein said constant voltage applying means includes a DC power supply and a voltage divider connected between the supply and the processor sub-circuit.

15. The multi-sensor alarm system as defined in claim 1; and further comprising alarm indicator means for indicating the presence of the alarm signal in an ON-state, and the absence of the alarm signal in an OFF-state; and latching means for maintaining the alarm indicator means in the ON-state whenever said alarm signal is generated.

16. The multi-sensor alarm system as defined in claim 15; and further comprising manually-resettable means for deactuating the latching means to thereby return the alarm indicator means to the OFF-state.

17. The multi-sensor alarm system as defined in claim 1; and further comprising third sensor means electrically connected in the same two-wire closed loop circuit path for detecting the alarm event; and wherein said load impedance is located at one end of the circuit path; and wherein said first sensor means is located in the circuit path at a location nearest to the load impedance; and wherein said second sensor means is located in the circuit path at a location furthest away from the load impedance; and wherein said third sensor means is located in the circuit path at an intermediate location between the locations where the first and the second sensor means are located.

18. The multi-sensor alarm system as defined in claim 17, wherein said first sensor means is a perimeter-type sensor for protecting the perimeter of a premises in which the alarm system is installed; and wherein said third sensor means is a room-type sensor for protecting the interior room areas of the premises; and wherein said second sensor means is an interior-type sensor for protecting items located in the room areas of the premises; all of said sensor means being separately and independently operable to track the course of an intruder through the premises.

19. The multi-sensor alarm system as defined in claim 1, wherein said sensor means are electrically connected in the two-wire closed loop circuit path such that one sensor means is actuatable even after another sensor means has been actuated and has remained in its respective alarm state.

20. The multi-sensor alarm system as defined in claim 1, wherein one of said sensor means is of the automatically-rearming type, and wherein said sensor means are electrically connected in the two-wire closed loop circuit path such that another of the sensor means is actuatable even after said one automatically rearming sensor means has been actuated and has rearmed itself to its respective non-alarm state.

21. The multi-sensor alarm system as defined in claim 1, wherein said first sensor means and said second sensor means are connected in the two-wire closed loop circuit path for only detecting a first alarm event; and further comprising an additional electrical circuit means, an additional first and second sensor means, and an additional alarm means all interconnected for only detecting a second alarm event which is different from said first alarm event.

22. A method of protecting a premises, comprising the steps of:

(a) establishing a two-wire closed loop main circuit path about the premises;

(b) conducting an electrical current through the main circuit path;

(c) electrically connecting a first sensor means in the main circuit path for detecting an alarm event, said first sensor means being actuatable in response to detection of the alarm event from a non-alarm state in which the electrical current is conducted through the first sensor means, to an alarm state in which the electrical current is prevented from being conducted through the first sensor means;

(d) electrically connecting a second sensor means in the main circuit path for detecting the alarm event, said second sensor means being actuatable in response to detection of the alarm event from a non-alarm state in which the electrical current is prevented from being conducted through the second sensor means, to an alarm state in which the electrical current is conducted through the second sensor means;

(e) differently changing the electrical characteristics of the main circuit path by respective actuation of each sensor means between its respective states;

(f) sensing each differently changed electrical characteristic of the main circuit path, and generating an alarm signal when either of the sensor means is in its respective alarm state, said sensing step including the step of electrically connecting an actuatable switching element in the main circuit path, said alarm signal generating step including the step of establishing an equilibrium condition for the switching element which is intermediate its fully-on and fully-off switched conditions; and (g) separately indicating when both sensor means are in their non-alarm state and said switching element is in its equilibrium condition, when said first sensor means is in its respective alarm state and said switching element is in one of its switched conditions, and when said second sensor means is in its respective alarm state and said switching element is in the other of its switched conditions.

23. The method of claim 22, wherein said sensing step includes detecting current and voltage changes in the main circuit path, and wherein said alarm signal generating step includes generating a non-alarm signal when the current and voltage parameters of the main circuit path are at predetermined values, and also generating the alarm signal when the current and voltage parameters are at values different from said predetermined values.

24. The method of claim 23, wherein said alarm signal generating step generates the alarm signal when the current and voltage parameters are less then, as well as greater than, said predetermined values.

25. The method of claim 22; and further comprising the step of maintaining the generation of the alarm signal for a predetermined time period whose duration is independent of when said alarm event terminates.

26. The method of claim 22; and further comprising the step of installing the sensor means in the main circuit path such that the generation of an alarm signal upon actuation of one of the sensor means is independent from the subsequent generation of another alarm signal upon actuation of the other of the sensor means.

27. The method of claim 22; and further comprising the step of tracking the course of an intruder through the premises to be protected, including the steps of installing the first sensor means about the perimeter of the premises to be protected; installing the second sensor means on an item located in an interior room of the premises; and installing a third room-type sensor means in an interior room area of the premises.

28. The method of claim 22, wherein said alarm signal generating step is performed by generating an alarm signal in response to actuation of one of said sensor means even after another of said sensor means has been actuated and has remained in its respective alarm state.

29. The method of claim 22, wherein one of said sensor means is of the automatically-rearming type, and wherein said alarm signal generating step is performed by generating an alarm signal in response to actuation of another of said sensor means even after said one automatically rearming sensor means has been actuated and has rearmed itself to its respective non-alarm state.

* * * * *